US005432965A

United States Patent [19]

Espinoza

[11] Patent Number: 5,432,965

[45] Date of Patent: Jul. 18, 1995

[54] INFANT COVERING BLANKET

[76] Inventor: Daniel Espinoza, 10716 Orange Grove Ave. #4, Whittier, Calif. 90601

[21] Appl. No.: 238,272

[22] Filed: May 4, 1994

[51] Int. Cl.[6] ..... A47G 9/04

[52] U.S. Cl. ..... 5/482; 5/502

[58] Field of Search ..... 5/502, 482, 498, 494, 5/496, 417, 94, 922, 655; 297/219.12, 184.13; 2/69, 69.5

[56] References Cited

U.S. PATENT DOCUMENTS

| | | | |
|---|---|---|---|
| 1,704,346 | 3/1929 | Schneider | 297/219.12 |
| 4,254,900 | 3/1981 | Wheeler | 224/158 |
| 4,478,453 | 10/1984 | Schutz | 297/219.12 |
| 4,761,032 | 8/1988 | Sanchez et al. | 297/184.13 |
| 4,993,090 | 2/1991 | Ranalli | 5/494 |
| 5,243,724 | 9/1993 | Barnes | 297/219.12 |

*Primary Examiner*—Alexander Grosz
*Attorney, Agent, or Firm*—Roth & Goldman

[57] ABSTRACT

An infant blanket for use in combination with an infant carrying seat having a handle is disclosed. The blanket preferably is multi-layered having a border strip at its perimeter and a handle reception slit spaced from the perimeter so as to receive the handle of an infant carrying seat therethrough and means for fastening spaced portions of the blanket perimeter together to cover an infant in a carrying seat while exposing a handle of the carrying seat through the slit. Preferably, the blanket has layers made of different materials such as a first layer of water repellant material and a second layer of porous quilted material, with fastening strips such as hook and loop type pieces attached to it so that the blanket can be secured about an infant. The blanket is preferably placed over an infant carrying device like a vehicle seat and the infant is then covered with the blanket. The slit in the blanket allows the user to fully access to the handle and at the same time as the blanket covers the infant.

6 Claims, 1 Drawing Sheet

INFANT COVERING BLANKET

BACKGROUND OF THE INVENTION AND PRIOR ART

The invention broadly relates to blankets used to protect humans, especially infants from the elements like cold, wind, dust, etc. In particular, the blankets are used in conjunction with infant handling devices like carriages, carriers and other similar articles.

Several blankets are known both for adults as well as for children, however these blankets can only be used by themselves and not in conjunction with anything else. Further they are too bulky or cumbersome to carry around and are not readily available when needed. When used in conjunction with infant carriers the blanket either completely covers the seat thus denying access to the seat handle and making it almost impossible to carry a child in the seat safely or if folded does not offer enough material to cover the infant, leading to its exposure. Therefore a need exists for an inexpensive and convenient blanket that can be used in various places including infant carriers, and vehicle seats.

Most states now have laws requiring infants to be restrained in special safety seats whenever they are travelling in vehicles. Therefore every parent is required by law in most places to place their infants in such seats. Ideally parents desire one seat that they can place their infant in, can carry them around and if travelling by a vehicle, strap the infant in the same seat. Such seats are available in the market, however there are no adequate coverings or protection provided with these seats. There is real need for a blanket that can be used in conjunction with such seats. The alternative of using heavy or warm clothes for the infant is not always practical because some of these warm clothes may irritate the tender baby skin. Further having a large number of clothes may not be practical and difficult to carry around and/or to store. It may also put an unnecessary costly burden on some parents. This invention solves the above mentioned problems by providing a blanket that allows the parents to get a good grip on the infant seat and which is economical.

SUMMARY OF THE INVENTION

The present invention provides an infant blanket for use in combination with an infant carrying seat having a handle, said blanket having a perimeter, a handle reception slit spaced from said perimeter for receiving the handle of an infant carrying seat therethrough and means for fastening spaced portions or said blanket perimeter together to cover an infant in a carrying seat while exposing a handle of the carrying seat through said slit.

Preferably, the blanket can have opposite sides made of different materials such as one side made of water repellant material and the other side made of porous quilted material. The fastening means preferably comprise hook and loop type fastener, such as the one sold under the trademark VELCRO pieces attached to selected locations on the blanket so that the blanket can be secured over the infant. Ordinarily, the blanket is first placed over an infant carrying device like a vehicle seat and the infant is then placed in the seat on the blanket and covered with the blanket. The slit in the blanket allows the the user to easily access the handle while at the same time the blanket covers the infant.

DESCRIPTION OF THE PREFERRED EMBODIMENTS

Figure 1:
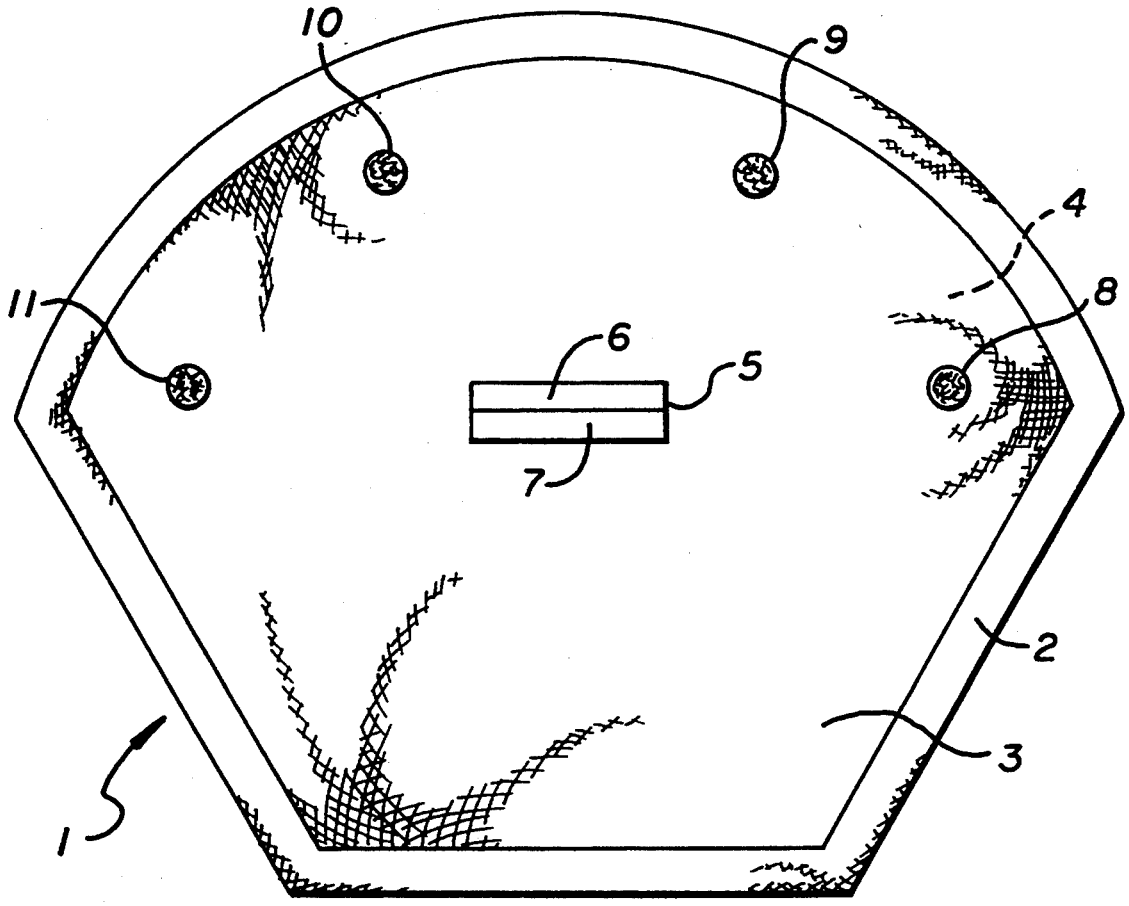
FIG. 1 is a plan view of the blanket.

Referring to FIG. 1 of the drawing 1 generally depicts the blanket of the invention. The perimeter of the blanket 1 is covered with a border 2 strip which affixes two layers of the blanket together. The blanket has a first layer 3, preferably made of a porous or breathable material to keep the infant warm, e.g. quilted material, and a second layer 4 of the blanket is preferably made of a rubberized or otherwise water resistant material. An infant carrier handle reception slit 5 is made at a desired location on the blanket. The slit 5 is bounded on both sides by border strips 6 and 7 sewn to the blanket to fasten the edges of the first and second layers 3, 4 together at the edges of the slit 5. Strips of fastening material such as hook and loop type fastener, such as the one sold under the trademark VELCRO patches 8, 9, 10 & 11 are placed on the blanket 1 so that when it is desired to cover the infant, the blanket can be folded over and the edges secured to each other by means of cooperating pairs of fastening strips. Hook and loop type fastener, such as the one sold under the trademark VELCRO strips are the preferred securing means over other devices like buckles, clips, snaps and other small devices which may have sharp edges that can pose a safety hazard or be small enough that an infant could swallow them.

The blanket has several uses that are described hereinafter. The blanket may be used as a protective cover when the infant is placed in a protective seat like a vehicle seat. The blanket may be placed over the seat such that the vehicle seat handle is inserted through the slit in the blanket and is available on the other side of the blanket for the user to firmly hold or carry the seat. Alternatively the infant may be placed first in the seat and the blanket placed on top of the infant and the seat. The seat handle protrudes through the slit as stated above. However in this use the blanket forms a tent-like covering over the seat with the infant in it. Yet another use contemplated for the blanket is as a child play mat. The water resistant surface conventiently acts as a non-slip surface on a smooth floor such as wood or linoleum.

Persons skilled in the art will readily appreciate that various modifications can be made from the preferred embodiment thus the scope of protection is intended to be defined only by the limitations of the appended claims.

I claim:

1. An infant covering blanket for use in combination with an infant carrying seat having a handle, said blanket having a perimeter and a central area, a handle reception slit spaced from said perimeter, located in said central area, for receiving the handle of an infant carrying seat therethrough and means for fastening spaced portions of said blanket perimeter together to cover an infant in a carrying seat while exposing a handle of the carrying seat through said slit.

2. The blanket of claim 1, wherein said means for fastening comprise hook and loop type strips.

3. The blanket of claim 1, further having first and second layers of different characteristics, one layer being water repellent and the other layer being porous.

4. The blanket of claim 3, wherein said porous layer is quilted.

5. The blanket of claim 1, wherein said blanket is sized to cover both an infant in a carrying seat and the carrying seat.

6. The blanket of claim 5, wherein said slit is positioned substantially in the center of said blanket.

* * * * *